United States Patent [19]

Pike

[11] 4,389,218

[45] Jun. 21, 1983

[54] PRODUCTION OF SOLID FUEL SHAPES FROM COAL FINES

[75] Inventor: John C. Pike, Federal Way, Wash.

[73] Assignee: Blackfire Coal Products, Federal Way, Wash.

[21] Appl. No.: 302,827

[22] Filed: Sep. 16, 1981

[51] Int. Cl.[3] ..... C10L 5/20; C10L 5/32

[52] U.S. Cl. ..... 44/6; 44/10 G; 44/14; 44/16 F

[58] Field of Search ..... 44/16 F, 6, 14, 10 H, 44/10 G

[56] References Cited

U.S. PATENT DOCUMENTS

| | | | |
|---|---|---|---|
| 1,311,221 | 7/1919 | Ellis | 44/16 F |
| 1,743,985 | 1/1930 | Strehlenert | 44/16 F |
| 1,912,697 | 6/1933 | Fife | 44/6 |
| 3,297,419 | 1/1967 | Eyre, Jr. | 44/6 |
| 3,635,684 | 1/1972 | Seymour | 44/10 |
| 3,684,465 | 8/1972 | Hsu | 44/10 |
| 3,829,297 | 8/1974 | Crawford | 44/15 |
| 3,883,317 | 5/1975 | Neme | 44/14 |
| 4,152,119 | 5/1979 | Schulz | 44/1 D |
| 4,230,459 | 10/1980 | Moreau et al. | 44/16 F |
| 4,238,200 | 12/1980 | Richter | 44/16 F |
| 4,243,393 | 1/1981 | Christian | 44/14 |

FOREIGN PATENT DOCUMENTS

| | | | |
|---|---|---|---|
| 1272 | 4/1926 | Australia | 44/16 F |
| 12516 | of 1906 | United Kingdom | 44/16 F |
| 197901 | 6/1923 | United Kingdom | 44/16 F |
| 211528 | 2/1924 | United Kingdom | 44/16 F |

*Primary Examiner*—Carl F. Dees

[57] ABSTRACT

Dry, random size, mine run coal fines are mixed with a concentrated liquor by-product (e.g. ammonium lignin sulfonate liquor, 40–60% solids by weight) of a sulfite paper making process of an amount sufficient to merely wet the coal fines such that they will hold shape when compressed. The wet coal fines are formed into large shapes (e.g. cylindrical logs or rectangular blocks) and the shapes are compressed. The wet coal fines are hopper fed into mold cavities and within the mold cavities are subjected to pressures within the range of 2,000–3,000 psi. The dried shapes are coated with a wax substance.

11 Claims, 8 Drawing Figures

PRODUCTION OF SOLID FUEL SHAPES FROM COAL FINES

DESCRIPTION

Technical Field

The present invention relates to an inexpensive solid fuel produced from waste coal dust or fines and a concentrated liquor by-product of the sulfite paper making process, and to a method of manufacturing such solid fuel.

Background Art

The patent literature contains a large number of patents relating to various methods of casting mixtures of coal particles and various binder materials into solid fuel shapes. With but one exception, a common denominator of these prior patents is the believe that it was not possible to use a sulfite liquor by product of the sulfite paper making process along as a binder.

U.S. Pat. No. 1,678,387, granted July 24, 1928, to Robert M. Hale, suggests obtaining a good bond by using coal fines which have been oil-coated before being mixed with the lignin material. U.S. Pat. No. 585,001, granted June 22, 1897, to Nicoll MacDonald, discloses adding lime water to a mixture which includes coal particles and "pulped paper", coal-tar and crude petroleum. U.S. Pat. No. 782,991, granted Feb. 21, 1905, to Samuel P. Sadtler, discloses adding sodium carbonate to a mixture of the "fine coke-powder" and "concentrated waste liquor of the sulfite wood-pulp process". U.S. Pat. No. 969,504, granted Sept. 6, 1910, to Ernst Trainer, discloses the addition of a chromium compound to obtain a good bond. U.S. Pat. No. 1,084,479, granted Jan. 13, 1914, to Max Platsch, discloses the addition of sulfuric acid. U.S. Pat. No. 1,507,676, granted Sept. 9, 1924, to Theodore Nagel, discloses the addition of phosphoric acid. U.S. Pat. No. 1,576,248, granted Mar. 9, 1929 to Jacob S. Robeson, discloses adding "crude molasses" and "wood tar". U.S. Pat. No. 1,596,239, granted Aug. 17, 1926, to John P. Delzeit, discloses adding "sulfur" and "sulfuric acid". U.S. Pat. No. 1,615,463, granted Jan. 25, 1927, to Michael F. Maginnis, discloses adding "starch", "glue" and "alum". U.S. Pat. No. 1,618,249, granted Feb. 22, 1927, to Samuel F. Walton, discloses adding a "cellulose solution". It is stated in this patent that the cellulose apparently forms a physical union with the sulfite liquor. It is said that the cellulose protects the briquettes from the effects of water or moisture until they are generally carbonized by combustion in use. The patentee states that "unless carbonized or otherwise chemically treated, sulfite liquor by itself would be unsatisfactory as a binder, because it is hygroscopic and absorbs moisture; so that after mere drawing briquette bonded with sulfite liquor alone would absorb moisture from the atmosphere and disintegrate". The patentee further states "cellulose used alone as a binder, on the other hand, would disintegrate in burning".

U.S. Pat. No. 1,623,764, granted Apr. 5, 1927, to Srinivas R. Wagel, discloses adding "clay and asphalt". U.S. Pat. No. 1,752,838, granted Apr. 1, 1930, to Francis M. Crossman, discloses adding "raw starch or any farinaceous material containing starch and gluten", and a small percentage of "sodium nitrate". U.S. Pat. No. 1,908,862, granted May 16, 1933, to Charles H. Reese, discloses adding "lime" and "a coagulant such as gellatin or glue". U.S. Pat. No. 2,567,136, granted Sept. 4, 1951, to Antoine Vloeberhgs, discloses the addition of a "phenolformaldehyde resin". U.S. Pat. No. 829,042, granted Aug. 21, 1906, to Bernhard Wagner, teaches manufacturing briquettes by (1) heating "anthracite" up to about 140 degrees centigrade; (2) heating waste lyes from cellulose-factories up to about 60 degrees centigrade; (3) mixing the two substances together in a mixing apparatus while maintaining a temperature of the mixture of about 100 degrees centigrade; and (4) feeding the mixture into a press at about 100 degrees centigrade. The patentee states that for the purpose of maintaining the mass at the proper degree of temperature in a mixing apparatus, and of enabling anthracite or other material used and the binding medium to be intimately mingled as possible, super heated steam may advantageously be conducted directly into the mixture.

The single patent which discloses using waste sulfite liquor alone is U.S. Pat. No. 1,667,304, granted Apr. 24, 1928, to Ernst W. Bowen. Bowen states that he is able to obtain proper bonding by first separating the fine dust or flour from the granular portion of the anthracite or other coal. The granular portion of the coal is mixed with a waste sulphite liquor obtained from wood-pulp mills, and then the dust or flour is added to the mixture "in definite proportions". The patentee suggests separating the flour from the granular parts by a two stage screening process. The granular coal is dried and is then mixed with sulphite liquor at about 150 degrees Fahrenheit in a suitable machine which ensures a thorough distribution of the liquor throughout the granular material. This mixture consists of 86 percent by weight of granular to 9 percent by weight of sulphite liquor. After these constituants have been thoroughly mixed, approximately 5 percent dust or flour is added and the mixing operation is repeated until the mass becomes truly plastic. The plastic mass is molded into briquettes which are baked at a temperature of about 630 degrees Fahrenheit for approximately twenty minutes and are then cooled.

U.S. Pat. No. 3,684,465, granted Aug. 15, 1972, to Harry L. Hsu, discloses the use of ammonium lignin sulfonate liquor as a binder material in the manufacture of fuel briquets. Specifically, this patent discloses that the amount of binder employed should be between about 3 and about 10 parts by weight per 100 parts of the carbon aggregate employed. It also states that in all cases the total amount of water employed in any given mixture should be between about 5.0 and about 8.0 parts per weight per 100 parts of the carbon aggregate and the parts of water used is inclusive of the water or moisture contained in the carbon aggregate materials and in the binder. The mixture is formed into the desired shape in a roll briquetting operation employing a pressure force of at least 1.0 metric ton per centimeter of face contact.

The above described patents, and the additional patents listed below, all should be carefully considered for the purpose of putting the present invention into proper perspective; U.S. Pat. No. 478,229, granted July 5, 1892, to Jerome W. Frank; U.S. Pat. No. 257,985, granted May 16, 1882, to William C. Siffken; U.S. Pat. No. 829,072, granted Aug. 21, 1906, to Henry Hill; U.S. Pat. No. 1,780,205, granted Nov. 4, 1930, to Henry F. Maurel; U.S. Pat. No. 3,297,419, granted Jan. 10, 1967, to Edward E. Eyre, Jr.; U.S. Pat. No. 3,635,684, granted Jan. 18, 1972, to Donald E. Seymour; U.S. Pat. No. 3,829,297, granted Aug. 13, 1974, to Chester C. Crawford; U.S. Pat. No. 3,883,317, granted May 13, 1975, to Fuhad A. Neme; U.S. Pat. No. 4,152,119, granted May 1, 1979, to Helmut W. Schulz; U.S. Pat. No. 4,230,459, granted Oct. 28, 1980, to Jean R. Mareau, Martin P. Pelletier and Gerard B. Tremblay; and U.S. Pat. No. 4,243,393, granted Jan. 6, 1981, to Miles W. Christian.

DESCRIPTION OF THE INVENTION

In accordance with the present invention, waste coal fines are combined with ammonium lignin sulfonate liquor, or an equivalent by-product of a paper manufacturing process, to produce relatively large size fuel shapes, viz. logs or bricks.

In accordance with an aspect of the invention, substantially dry coal fines are combined with only enough concentrated liquor to wet surface portions of the fines. The coal fines, wetted in this manner, are placed into molds and are tightly compressed together to form the fuel shapes. The fuel shapes are then removed from the molds and are dried.

According to an aspect of the invention, the liquor is thinned by heating prior to its being combined with the coal fines. Thinning in this manner facilitates an even distribution of the liquor throughout the coal fines.

In accordance with another aspect of the invention, coal fines which when obtained have a moisture content of more than 5% by weight are dried before combining them with the liquor until the moisture in them is no more than about 5% by weight. Preferably, the coal fines are dried by fluidizing them with heated air. The heated air may be air obtained from a dryer used for drying the compressed fuel shapes.

Preferably, the by-product liquor is ammonium lignin sulfate liquor. Preferably also, a liquor is used which includes between 40–60% solids by weight.

In accordance with another aspect of the invention, the by-product liquor is used in a quantity and concentration such that the ratio of wet coal fines to liquor solids is between 13:1 and 20:1 by weight, and the total moisture is between 3% and 7% by weight.

Preferably, the by-product liquor is heated to a temperature of about 180 degrees F. to about 220 degrees F. prior to combining it with the coal fines.

In accordance with an aspect of the invention, the liquor wetted coal fines are placed into log forming cavities and are compressed by hydraulically moving a piston in through one end of the cavity, against the liquor wetted coal fines, while closing the opposite end of the cavity.

In accordance with yet another aspect of the invention, the shapes are removed from their molds and are dried. Air drying will work. However, the preferred practice is to place the shapes into ovens and heat them in such ovens to no more than about 200 degrees F. until they are sufficiently hardened so that they will hold together during normal handling and during the burning process. Normally, this requires heating for about 2 to about 6 hours.

In accordance with another aspect of the invention, after drying the solid fuel shapes are coated with a wax substance, e.g. slack wax, parafin etc.

Additional objects, features and advantages of the invention will be apparent from the following description of a preferred embodiment of the invention.

BRIEF DESCRIPTION OF THE DRAWING FIGURES

Referring to the drawing.

DESCRIPTION OF THE PREFERRED EMBODIMENT

Figure 1:
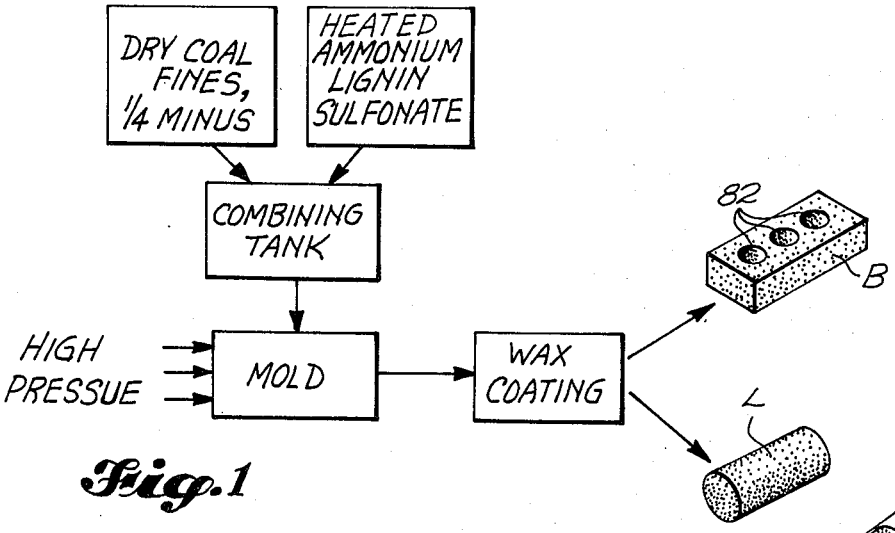
FIG. 1 is a flow diagram of an ebodiment of the process of the invention.

Referring to FIG. 1, dry coal fines, one quarter minus, and a suitable liquor by-product of a paper making process are combined together in such a manner that the liquor is substantially evenly disbursed or distributed amongst the coal fines.

Preferably, mine run coal fines are used because they are a waste product. At the present time there is an abundant supply of one quarter minus mine run coal fines. However, under some circumstances, it might be desirable to crush larger coal particles to produce the coal fines.

The coal fines may come from the mines or storage in a dry enough condition that drying is not necessary before combining them with the by-product liquor. This would be particularly true when the coal fines are obtained from mining operations conducted during the warm months of the year. However, when the coal fines are obtained with the moisture content greater than about 5% by weight, it is necessary to dry them before use. Preferably, the coal fines are dried by fluidizing them with heated air. Heated air may be obtained from a dryer or oven used to dry the fuel shapes. For example, a fan or pump may be used to remove air from the interior of the dryer to the inlet of a fluidized bed through which the coal particles must pass before being combined with the by-product liquor.

In accordance with the invention, a concentrated liquor is used so that it will add very little moisture which must later be removed. The concentrated liquor is heated, preferably to a temperature of about 180 degrees F. to about 220 degrees F., before being combined with the coal fines. When cold, the concentrated liquor has the consistency of a thick molasses. The heating thins the liquor to a water like consistency, so that it can be substantially uniformly disbursed throughout the coal fines.

By-product liquor is used in only an amount sufficient to wet the coal fines. In other words, it all becomes a thin coating on surface portions of the coal fines and does not exist in a liquid form, droplet or otherwise, between the coal fines.

Preferably, the by-product liquor used includes between 40–60% solids by weight. By way of example, the by-product liquor may be the liquid form of an ammonium lignin sulfonate liquor which is sold by The Scott Paper Company, a Pennsylvania Corporation, under the trademark TREX R LTA.

This material is a liquid form of ammonium lignin sulfonate and wood sugars. It is manufactured by the sulfite paper making process as a co-product with wood pulp. Prior to digestion, wood consists of bundles of cellulose fibers cemented together by lignin and hemicellulose. In the sulfite pulping process, ammonium lignin sulfonates and wood pulp are produced simultaneously by a series of chemical reactions when wood chips are cooked under controlled conditions of heat and pressure in an aqueous solution of ammonium bisulfite and sulphur dioxide. This is accomplished in a tall cylindrical pressure vessel known as a "digester". The ammonium bisulfite and sulphur dioxide reacte with lignin to form water soluable lignin sulphonate. The hemicelluloses (carbohydrates) are broken down into water soluble 5-carbon and 6-carbon reducing sugars, such as glucose, glactose, mannose, ylose, and arabinose. Simple filtration separates the wood pulp, which is to be made into paper, from the lignin sulfonates and other components, which are available as chemical raw materials. This coffee colored liquid or liquor is collected as a solution of about 10% solids, and is then concentrated by the removal of water to the 50–55% solids level in an all stainless evaporator. This concentrate is sold by Scott as TREX ® LTA and is a mixture of ammonium lignin sulphonates, wood sugars and other chemicals dissolved in water.

Additional information with respect to TREX ® LTA is contained in a Scott Paper Company brochure, entitled TREX ® lignin sulfonates. The contents of this brochure are hereby expressly incorporated by reference into this application. A copy of the brochure is in the patent file.

Fuel shapes constructed in accordance with the present invention typically fall within the size range of about 40 to about 300 cubic inches. By way of typical and therefore nonlimitive example, cylindrical logs may be manufactured which measure about 3–5 inches in diameter and about 6–15 inches in length. A preferred size of log measures about 4 inches in diameter by about 12 inches in length. Rectangular bricks, such as shown in FIG. 1 may measure about 2–3 inches in depth, by about 2–6 inches in width, by about 6–15 inches in length.

Whether the shapes be bricks or logs, in either case the liquor wetted coal fines are introduced into a mold and are subjected while in the mold to a pressure of at least 2000 psi. In a typical log manufacturing process, the pressure applied is preferably about 3000 psi, for a high quality product.

The liquor wetted coal fines are much like damp beach sand when they are placed in the mold. For example, a common cup could be had packed with the liquor wetted coal fines and then turned upside down and emptied onto a surface and the coal fines would assume a shape corresponding to the inside shape of the cup, in the same manner as if damp beach sand were used.

When the pressurized shapes are removed from the molds, they are relatively firm. The pressure compacting causes the liquor to bind the coal fines together. After they have been dried, the fuel shapes have the ability to hold together during shipping and other handling, and during the burning process.

The fuel shapes may be air dried. However, in preferred practice, drying is excellerated by placing the shapes within an oven and heating them to about 180 degrees F. to about 220 degrees F., for about 2 to about 6 hours. The oven temperature and heating time are so chosen that the fuel shape will solidify without excessive swelling or distortion. A very good product was obtained by heating the shapes in an oven at a temperature of about 200 degrees F. for about 2 hours. The particular shapes were in log form and they measured about 4 inches in diameter by about 12 inches in length.

Preferably, the fuel shape is dipped or spray coated with a suitable wax substance, such as "slack wax" or parafin.

"Slack wax" sometimes referred to as "grease wax", is a by-product of the petrolium refining process.

The wax coating has two distinct advantages. It seals the fuel shape, making it relatively clean to handle. That is, it prevents surface coal fines from coming off in the form of dust. Secondly, the wax coating helps the fuel shape become ignited, particularly if parafin is used.

Figure 4:
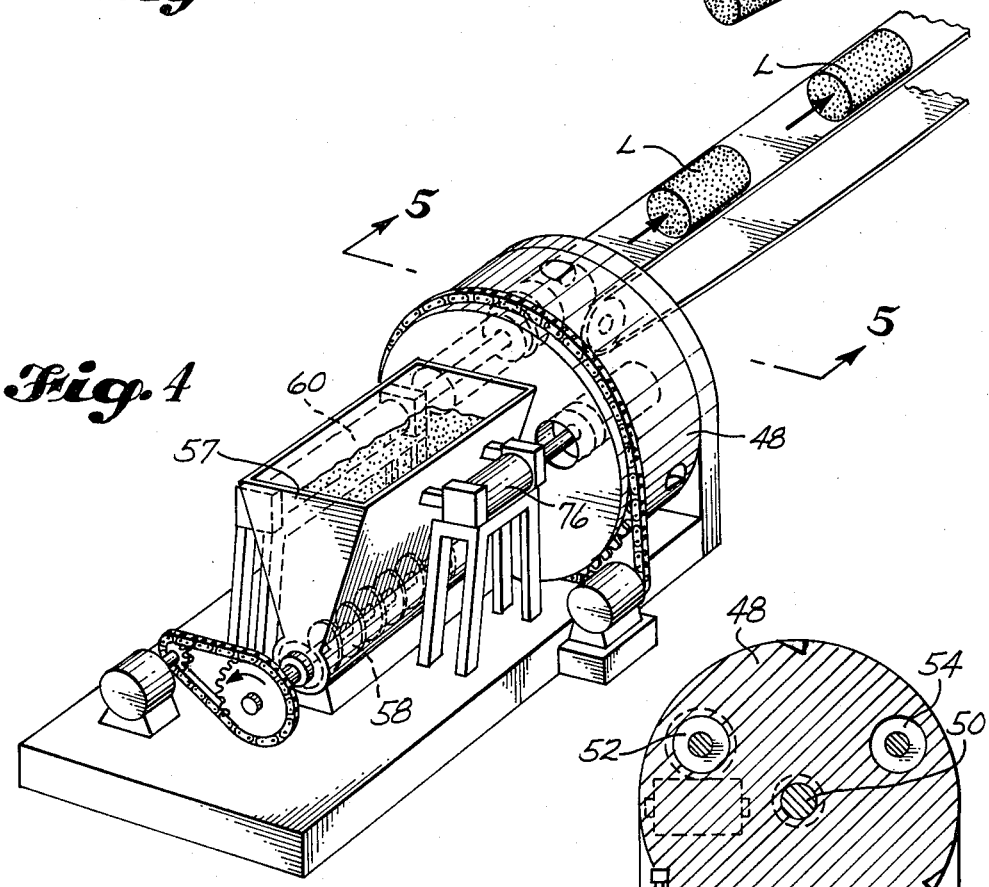
FIG. 4 is a pictorial view of a second machine for casting cylindrical fuel shapes or logs.
Figure 5:
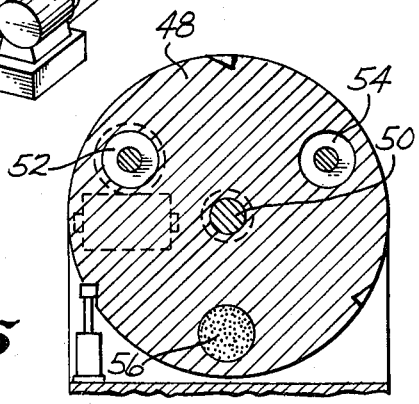
FIG. 5 is a cross-sectional view taken substantially along line 5—5 of FIG. 4.

A fuel log manufacturing operation will now be described, with reference to FIGS. 2–4.

Figure 2:
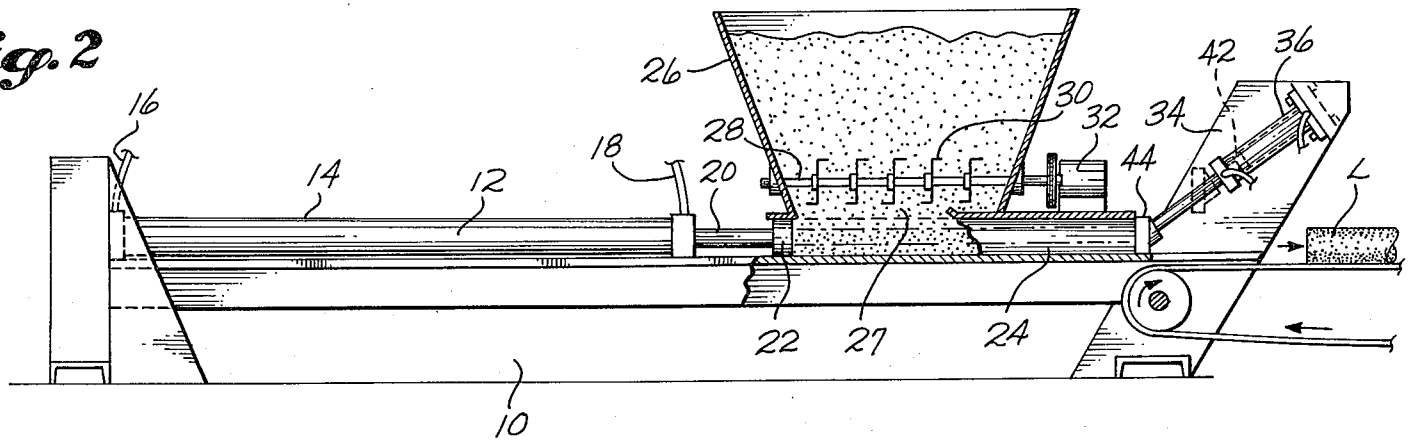
FIG. 2 is a side elevational view of a first embodiment of a fuel log forming machine.
Figure 3:
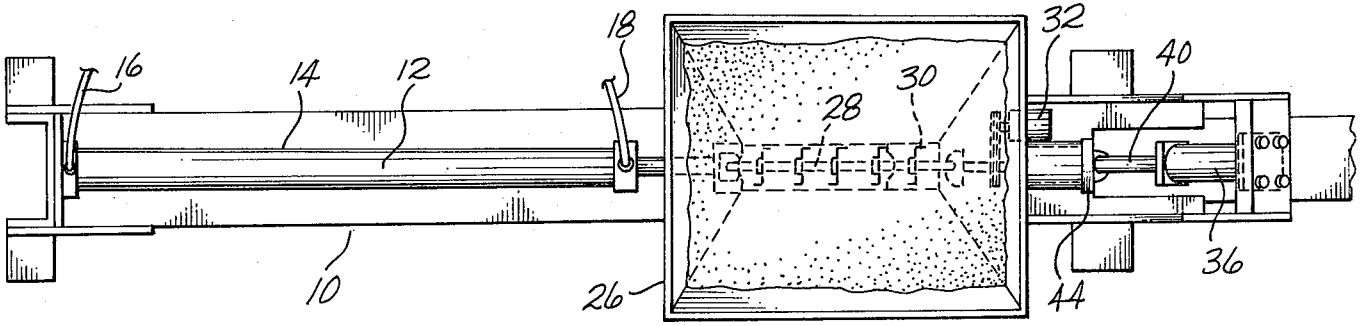
FIG. 3 is a top plan view of the machine shown by FIG. 2.
Figure 6:
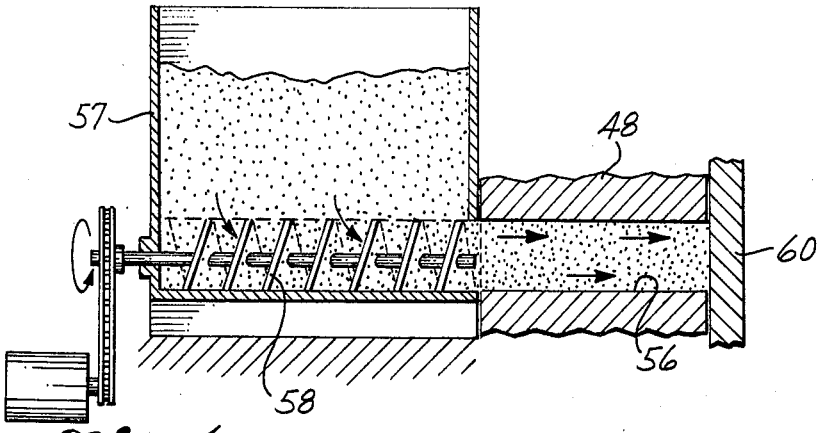
FIG. 6 is a longitudinal sectional view taken through the feed station.
Figure 7:
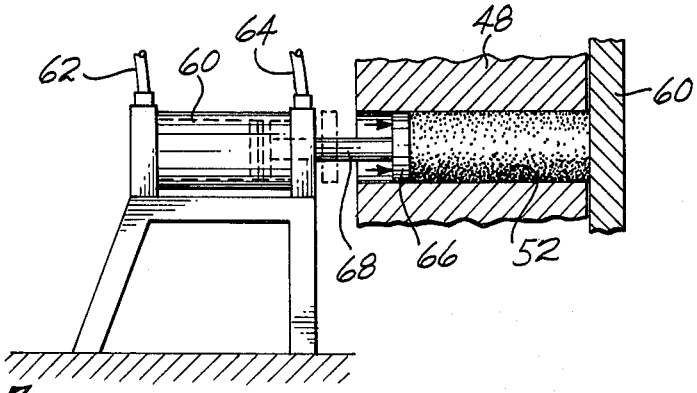
FIG. 7 is a longitudinal sectional view taken through the compact station.
Figure 8:
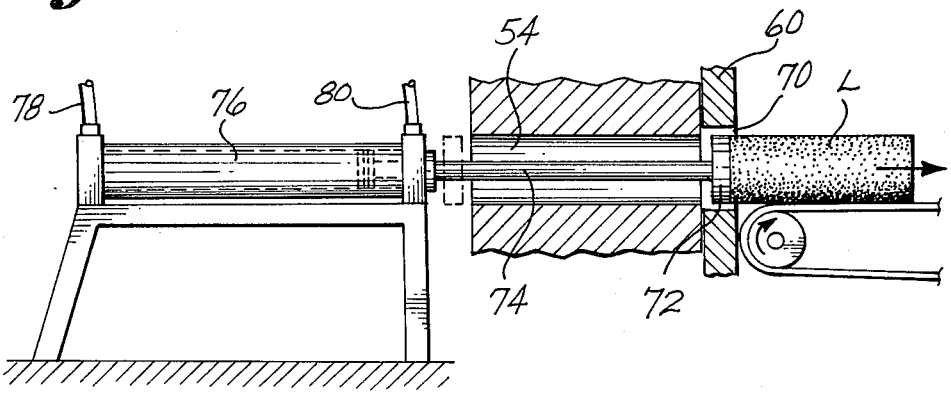
FIG. 8 is a longitudinal sectional view taken through the eject section.

The apparatus shown in FIGS. 2 and 3 comprises a main frame 10 which mounts a double acting hydraulic linear motor 12. Linear motor 12 comprises a cylinder 14, having a fluid line 16, 18 at each of its ends. In usual fashion, the lines, 16, 18 convey hydraulic fluid into and outfrom chambers formed on opposite sides of a piston head (not shown). A piston rod 20 extends outwardly from one end of the cylinder 14 and includes a pressure ram 22 at its outer end.

A cylindrical mold cavity is formed in line with the piston rod 20. An upper sidewall opening 27 in a first end portion of the cylindrical mold cavity 23 is in coal fine receiving communication with a hopper 26. The liquor wetted coal fines are introduced into the hopper 26 and are fed by the hopper 26 into the mold cavity 24. Preferably, a shaft 28 carrying a plurality of paddles 30 is mounted for rotation within the hopper 26, and is rotated by a motor 32, mounted on the frame 10 outside of the hopper 26. The paddles 30 keep the liquor wetted coal fines mass loose, allowing it to drop by gravity into the top opening 27 of the mold cavity 24.

The second end of the mold cavity 24 is opened and closed by means of retraction and extension of a second linear hydraulic motor 34. In the illustrated embodiment, motor 34 is set at an incline. Motor 34 concludes a cylinder 36, shown anchored to a frame member 38, and a piston 40. Piston 40 includes a piston head 42 at its inner end and a closure pad 44 at its outer end. When the piston 40 is extended, as shown in FIG. 3, the closure pad 44 is moved into a position whereat it closes an end opening provided in the mold cavity 24. Retraction of the piston 40 moves the closure pad 44 both away from the end opening and above the level of the end opening.

In operation, after a sufficient amount of the liquor wetted coal fines mass has been allowed to enter the mold cavity, the piston rod 20 is extended by operation of cylinder 14 while closure pad 44 is held against the opposite end of the mold cavity 24, by operation of linear motor 24. The pressure pad 22 is hydraulically moved against the liquor wetted coal fines within cavity 24, to in that manner, compress them tightly together. In the illustrated embodiment, the mold cavity 24 measures about 4 inches in diameter. The applied pressure was about 30,000 psi. When this pressure level was reached, the length of the pressurized mass within the cavity 24 was about 12 inches.

Following sufficient pressurization, the pressure is removed, piston 40 is retracted until the closure pad 44 is above the elevation of the end opening, and the piston 20 is again extended, this time for the purpose of moving the compressed fuel shape endwise outfrom the mold cavity 24. A conveyor (not shown) may be positioned at the outlet of the mold cavity, for conveying the fuel shapes onto the drying station.

A sliding gate (not shown) may be mounted on an upper portion of the mold cavity, to be adjustably movable endwise for the purpose of adjusting the length of the opening 27.

FIGS. 4–8 relate to a second embodiment of a mechanised mold for casting cylindrical fuel logs. This embodiment is characterized by a rotating turret 48, mounted for rotation about an axis 50. Turret 48 comprises three chambers 52, 54, 56.

A hopper fed screw feed mechanism 58 is provided for delivering liquor wetted coal fines into the chambers 52, 54, 56, one at a time. An end wall 60 provides a reaction surface at the second end of the particular chamber 52, 54, 56 which is in alignment with the feed mechanism 58. When a given cavity 52, 54, 56 is full, the turret 48 is rotated to place such cavity in line with the pressure pad 58 of a compaction device. The compaction device is a double acting linear hydraulic motor 60, having a pair of fluid lines 62, 64 leading to opposite ends of a cylinder chamber from a switching valve 66. When fluid is introduced into line 62 and removed from line 64, the piston 68 is extended and the pad 56 is moved into pressure applying contact with the liquor wetted coal fines within the mold cavity. At this station, the second end of the mold cavity is also closed by the wall 60.

Following sufficient compression, the switching valve 66 is reversed, directing fluid into line 64 and outfrom line 62, resulting in a retraction of the pressure pad 58 outfrom the mold cavity. The turret is once again rotated, the mold cavity into alignment with both an outlet opening 70 in the wall 60 and the head 72 of an ejector piston 74. Switching valve 76 is operated to cause the flow of hydraulic fluid into line 78 and the flow of hydraulic fluid outfrom line 80. The extending piston 74 moves against the end of the compressed fuel log L and moves it outfrom the mold cavity, through the opening 70 in wall 60. Following such removal, the position of valve 76 is reversed. Thus causes the delivery of hydraulic fluid into line 80 and outfrom line 78, and a retraction of the piston 74. The log L is then moved onto the drying station.

As should be evident, the provision of three mold cavities 52, 54, 56, enables one of the mold cavities to be at each of the three operational stations at each cycle of the operation. That is, while liquor wetted coal fines are being introduced into one of the cavities, the piston 68 is being extended to compress the liquor wetted coal fines in a second cavity and the piston 74 is being extended to eject a log L outfrom the third cavity.

Rectangular shape fuel pieces were successively manufactured in a conventional brick forming machine of the type used for casting structural bricks. The bricks were cast to include through openings 82, provided for the purpose of enhancing gasification during the burning process.

I claim:

1. A method of manufacturing solid fuel shapes in the nature of a log or brick, from coal particles, comprising:

mixing substantially dry coal particles with ammonium lignium sulphonate, in a quantity and concentration sufficient to produce a mixture in which the ratio of coal particles to lignium solids is between 13:1 and 20:1 by weight;

controlling the moisture in the mixture to an amount sufficient to cause the coal particles to merely be surface wetted;

providing a mold cavity having first and second open ends;

providing a closure over the first open end;

introducing some of said mixture into the second open end;

moving a piston into said second open end to compress the mixture into the shape of the mold cavity;

removing the closure from the first end of the cavity;

moving a piston through the cavity to move the shape outfrom the first end of the cavity;

heating the shape in a kiln to no more than about 200° F. until hardened; and providing the shape with a protective cover to prevent moisture absorption in the shape.

2. The method of claim 1, comprising drying the coal particles before mixing until the moisture in them is no more than about 5% by weight.

3. The method of claim 2, comprising drying the coal particles by fluidizing them with heated air.

4. The method of claim 1, comprising using ammonium lignium sulphonate liquor which includes between 40–60% solids by weight.

5. The method of claim 1, comprising using lignium in a quantity and concentration sufficient to produce a ratio of coal fines to lignium solids of about 16:1.

6. The method of claim 1, comprising and using an ammonium lignium sulphonate liquor which includes between 40–60% solids by weight, heated to a temperature of about 80° F. to about 220° F.

7. The method of claim 1, comprising forming at least one passageway through the fuel shape.

8. The method of claim 7, comprising forming a passageway through the shape while forming the shape.

9. The method of claim 1, comprising providing the shape with a protective cover by coating it with a wax substance.

10. The method of claim 9, comprising coating the shape with slack wax.

11. The product produced by any of claims 1–10.

* * * * *

UNITED STATES PATENT AND TRADEMARK OFFICE

CERTIFICATE OF CORRECTION

PATENT NO. : 4,389,218

DATED : June 21, 1983

INVENTOR(S) : John C. Pike

It is certified that error appears in the above-identified patent and that said Letters Patent are hereby corrected as shown below:

Column 1, line 18, "believe" should be --belief--.
Column 1, line 19, "by product" should be --by-product--.
Column 1, line 20, "along" should be --alone--.
Column 1, line 30, "the" should be deleted.
Column 4, line 66, "R" should be --®--.
Column 5, line 11, "reacte" should be --react--.
Column 5, line 51, "had" should be --hand--.
Column 6, line 10, "petrolium" should be --petroleum--.
Column 7, lines 9 and 10, "mechanised" should be --mechanized--.
Column 7, line 43, "Thus" should be --This--.
Claim 1, column 8, line 9, "lignium" should be --lignin--.
Claim 1, column 8, line 11, "lignium" should be --lignin--.
Claim 1, column 8, line 25, "outfrom" should be --out from--.
Claim 4, column 8, line 36, "lignium" should be --lignin--.
Claim 5, column 8, line 38, "lignium" should be --lignin--.
Claim 5, column 8, line 40, "lignium" should be --lignin--.
Claim 6, column 8, line 41, "and" should be deleted.
Claim 6, column 8, line 42, "lignium" should be --lignin--.
Claim 6, column 8, line 44, "80°" should be --180°--.

Signed and Sealed this

*Seventeenth* Day of *January 1984*

[SEAL]

*Attest:*

GERALD J. MOSSINGHOFF

*Attesting Officer*

*Commissioner of Patents and Trademarks*